US008393491B2

(12) United States Patent
Seelhofer

(10) Patent No.: US 8,393,491 B2
(45) Date of Patent: Mar. 12, 2013

(54) NECK CLOSURE COMPRISING A HERMETICALLY SEALED NECK AND ASSOCIATED COVER CAP FOR INITIAL OPENING

(75) Inventor: Fritz Seelhofer, Lindau (CH)

(73) Assignee: Belcap Switzerland AG (CH)

( * ) Notice: Subject to any disclaimer, the term of this patent is extended or adjusted under 35 U.S.C. 154(b) by 831 days.

(21) Appl. No.: 12/298,614

(22) PCT Filed: Apr. 19, 2007

(86) PCT No.: PCT/CH2007/000188

§ 371 (c)(1),
(2), (4) Date: Oct. 27, 2008

(87) PCT Pub. No.: WO2007/121602

PCT Pub. Date: Nov. 1, 2007

(65) Prior Publication Data

US 2009/0071961 A1 Mar. 19, 2009

(30) Foreign Application Priority Data

Apr. 25, 2006 (CH) ..... 687/06

(51) Int. Cl.

| | |
|---|---|
| ***B65D 41/06*** | (2006.01) |
| ***B67D 3/00*** | (2006.01) |
| ***B65D 47/28*** | (2006.01) |
| ***B65D 1/02*** | (2006.01) |

(52) U.S. Cl. ..... 220/293; 220/294; 215/43; 215/48; 222/505

(58) Field of Classification Search ..... 220/278, 220/270, 277, 254.8, 254.7, 294; 215/48, 215/44, 252, 250, 43; 222/153.05, 153.06, 222/153.07, 153.14, 568, 569, 566, 541.1, 222/541.2, 541.5, 505, 506, 80, 81
See application file for complete search history.

(56) References Cited

U.S. PATENT DOCUMENTS

| | | | | |
|---|---|---|---|---|
| 1,619,770 | A | | 3/1927 | Stewart |
| 4,669,124 | A | * | 5/1987 | Kimura ..... 383/80 |
| 5,339,982 | A | | 8/1994 | Tardie |

FOREIGN PATENT DOCUMENTS

| | | | |
|---|---|---|---|
| WO | 9962785 | | 12/1999 |
| WO | 0253469 | A1 | 7/2002 |
| WO | 04000667 | A1 | 12/2003 |

* cited by examiner

*Primary Examiner* — Robin Hylton
(74) *Attorney, Agent, or Firm* — Brooks Kushman P.C.

(57) ABSTRACT

The neck closure has a wedge-shaped hollow neck with lips formed on the front wedge edge by converging wedge surfaces, the lips being connected to form a one-piece closed lip by a thin section, and having a cover cap that can be placed over the neck. When the cover cap is in place, the front region of the wedge-shaped neck is held in a position that has been rotated through at least 5 DEG in a clockwise direction, viewed from above, in relation to its normal unstressed position, as a result of the inner moulding of the cover cap. When the cover cap is rotated anti-clockwise, from this closed position, force is only applied to the front wedge edge region of the neck by pressure surfaces projecting from the inner face of the cover cap at diametrically opposed points on said front wedge edge region.

20 Claims, 12 Drawing Sheets

FIG. 18
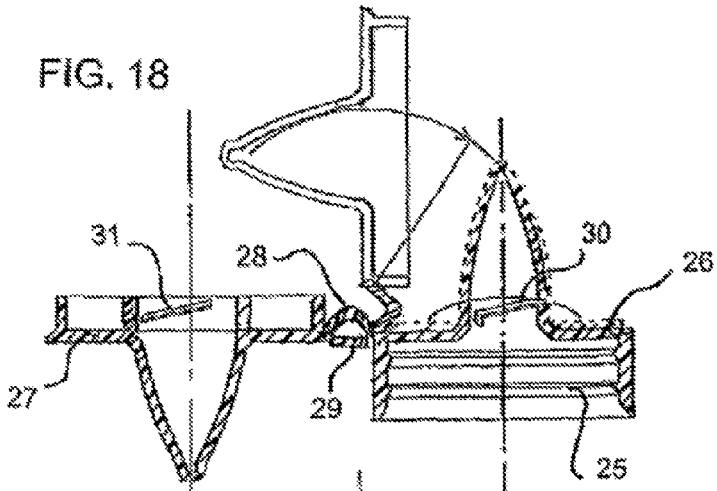
FIG. 19
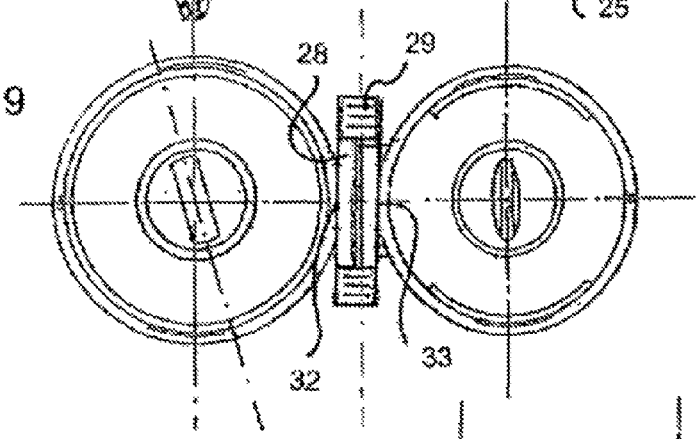
FIG. 20
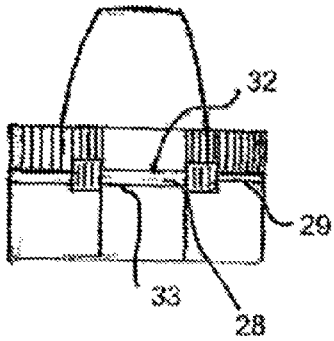
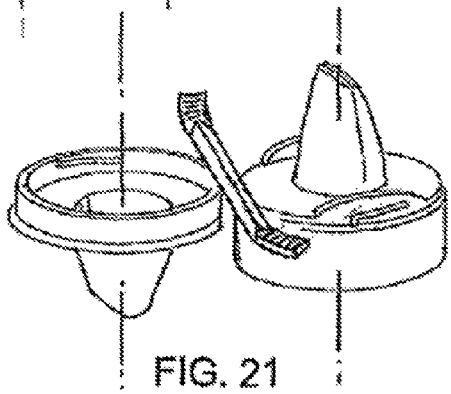
FIG. 21 a)

b)

c)

NECK CLOSURE COMPRISING A HERMETICALLY SEALED NECK AND ASSOCIATED COVER CAP FOR INITIAL OPENING

This invention relates to a neck closure comprising a hermetically sealed neck and cover cap for initial opening. This refers to the initial opening of the hermetically sealed neck which is intended as a drinking neck or else as a simple pore-out neck.

Such closures of multipart form are known. EP 1 084 062 shows a closure of this basic type. Practice has shown, however, that the neck cannot be opened reliably by the means disclosed there. To be precise, this neck is in the form of a hollow wedge with wedge faces slightly cambered on all sides. A closed lip is consequently formed at the front edge at which the wedge faces converge, each running-out wedge face or front edge of this wedge face forming one of the two lip parts. These two lip parts are initially connected in one piece to one another via a thin spot. The entire neck is produced from an elastically deformable material, preferably from elastomeric material, for example from a low-density polyethylene (LDPE). This neck is closed by a cap consisting of rigid material, for example of a polypropylene. The cap is slipped over the neck and surrounds the latter snugly. For removal, it has to be rotated counterclockwise, as seen from above, by the cap being twisted the uppermost part of the wedge-shaped neck also being twisted, with the result that the lip is to be opened. Practice shows that this opening does not take place reliably and satisfactorily. Furthermore, such a closure consisting of a neck and of an associated cap has hitherto, without exception, been produced in two separate parts, that is to say the neck is one injection molding and the associated cap is the other. This requires complicated assembly, this being correspondingly costly.

The object of this invention, therefore, is to provide a neck closure comprising a hermetically sealed neck and a cover cap for opening, in which the initial opening of the lip of the neck takes place reliably. Moreover, an object of this invention is to produce such a neck closure for a reliable initial opening of the neck lip in a variant as a one-part injection molding.

This object is achieved by a neck closure comprising a hermetically sealed neck and a cover cap for opening, consisting of a wedge-shaped hollow neck with lip parts which are formed at the front wedge edge by the two wedge faces tapering toward one another and which are connected in one piece via a thin spot to form a closed lip, and of a cover cap capable of being slipped over this wedge-shaped neck, characterized in that, in the slipped-over state of the cover cap, due to the internal shape of the cover cap the front region of the wedge-shaped neck is held, twisted clockwise, as seen from above, through at least 5° with respect to its detensioned normal position, and in that, when the cover cap is rotated out of this closing position, the front wedge edge region of the neck is acted upon counterclockwise, as seen from above, by pressure faces projecting on the inside of the cover cap, solely at points lying diagonally opposite one another on this front wedge edge region, and the remaining regions in the vicinity of the edge lie opposite a free space within the cover cap.

The figures show versions of this neck closure comprising a hermetically sealed neck and a cover cap for opening in various illustrations. They are described hereafter, and their function is explained.

In the figures:

FIG. 18 shows a neck closure with a cover cap connected in one part to the neck via a tear-away flap hinge, as illustrated in cross section;

FIG. 19 shows the neck closure according to FIG. 18, as seen from above;

FIG. 20 shows the neck closure according to FIG. 18 in the closed state, as seen from the rear;

FIG. 21 shows the neck closure according to FIG. 18 in the swung-open state of the cover cap, in a perspective view;

Figure 1:
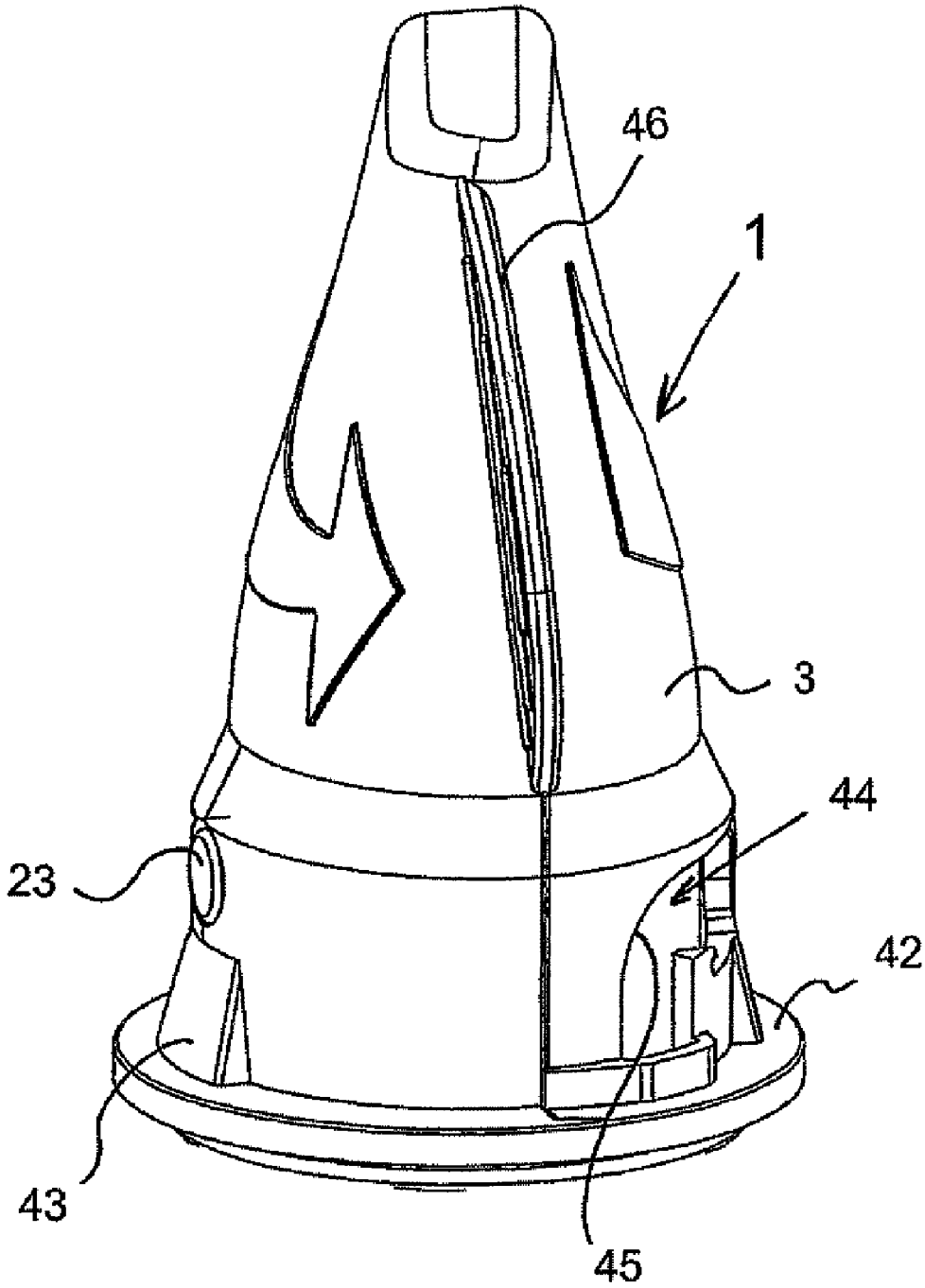
FIG. 1 shows the closure comprising the hermetically sealed neck and the cover cap mounted above it, in a view seen from the side.

In FIG. 1, the entire neck closure 1 comprising the hermetically sealed neck and the cover cap 3 mounted over it can be seen in a view from the side. The cover cap 3 can be seen here from the side, and one of the two grip lugs 46 faces the viewer. These grip lugs 46 make it easier to rotate the cover cap 3 even against resistance. What can be seen at the bottom is the base 42 on which the neck stands inside the cover cap 3 and on which the cover cap 3 lies. Arrows on the outside of the cover cap 1 indicate the direction in which the cover cap 1 is to be opened, that is to say counterclockwise, as seen from above. In the lower marginal region of the cover cap 1 can be seen a recess 44 which serves for the reception of a boss 23 on the neck. Such a boss 23 can be seen on the opposite side of the cover cap 1. This recess is delimited at the top by an arcuate margin 45. The outside of a sliding groove 43 can also be seen at the lower margin of the cover cap. When the cover cap 1 is slipped over, the bosses 23 first slide upward through this sliding groove 43 on the inside of the cover cap 1 and then, when the cover cap is released, through the adjacent sliding groove 47.

Figure 2:
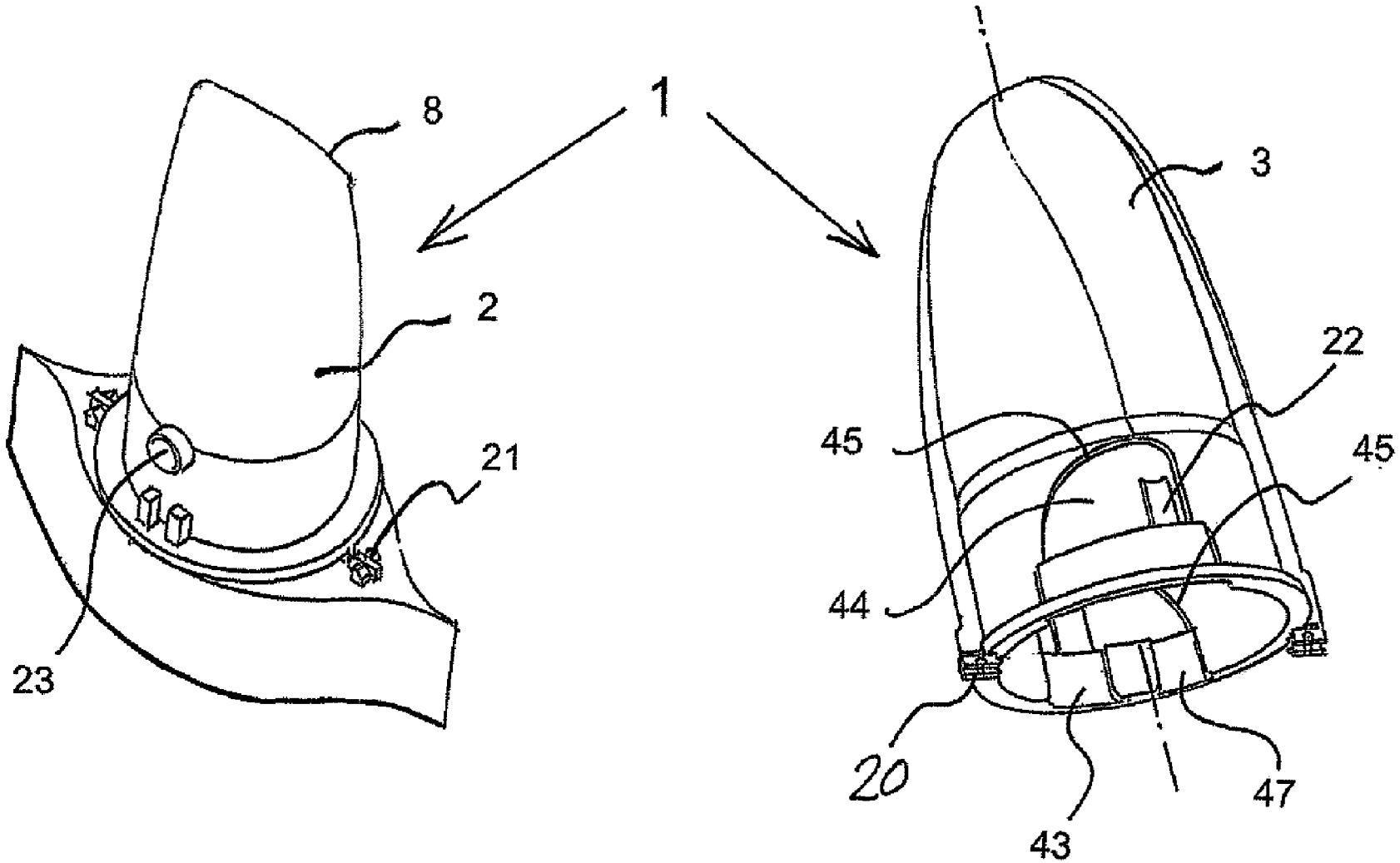
FIG. 2 shows the neck and the cover cap, illustrated separately next to one another.

FIG. 2 shows the neck 2 on the left and the associated cover cap 1 on the right. On the base of the neck 2, the latching elements 21 can be seen which cooperate with the latching elements 20 on the cover cap 3. Moreover, the recesses 44 on the cover cap 3 with their arcuate upper marginal boundaries 45 can be seen. Near the recess, which is viewed from inside the cap, can be seen the sliding groove 43 through which one boss 23 of the neck slides during attachment. As soon as the cover cap 3 is slipped completely over the neck 2, the bosses 23 latch in above the spring element 22. As can be seen at the cover cap 3, the latter is twisted upward somewhat to the right. This proves to be essential, since, as a result, the neck 2 injection-molded from elastic soft material is pretensioned clockwise, as seen from above.

Figure 3:
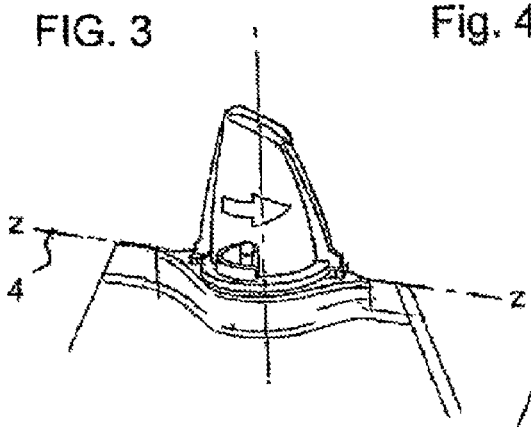
FIG. 3 shows the sealed neck closure mounted on a standing bag.
Figure 4:
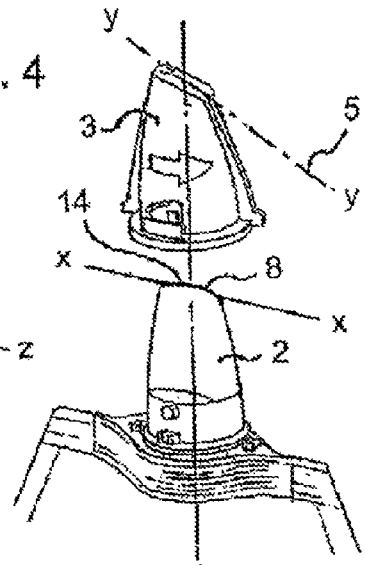
FIG. 4 shows the neck closure on the standing bag, with the cover cap lifted away.
Figure 5:
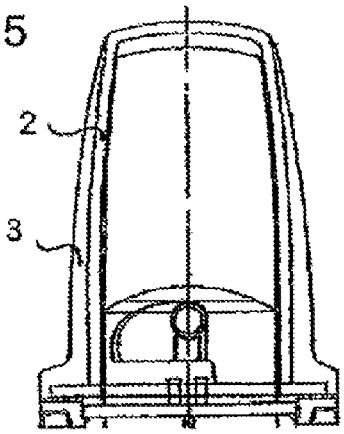
FIG. 5 shows the neck with slipped-over cover cap, in a section shown from the front.
Figure 6:
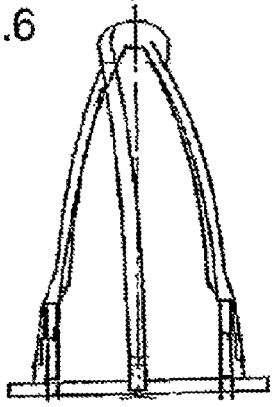
FIG. 6 shows the neck with slipped-over cover cap in a section shown from the side, with the contour of the cover cap being indicated.

This situation can be seen even more clearly from FIG. 3 which shows the sealed neck closure mounted on a standing bag. The shoulder of the standing bag runs along the z-z axis 4, while the y-y axis 5 of the top edge of the cover cap is twisted approximately 5° to the right with respect to the z-z axis 4. FIG. 4 illustrates the neck closure on the standing bag, with the cover cap lifted away. The two lip parts of the neck are closed via a thin spot. Moreover, here, it becomes clear that the x-x axis 8, along which the lip of the neck extends, runs parallel to the z-z axis 4, whereas the y-y axis 5 on the cover cap 3 forms an angle of approximately 5° to these axes. Accordingly, when the cover cap 3 is slipped on, the upper part of the neck, together with the lip, is forced into this y-y axis direction and therefore the lip is pretensioned. Furthermore, then, the inside of the cover cap is shaped and configured such that, when the cover cap is rotated out of the closing position counterclockwise, as seen from above, the front wedge edge region of the neck is acted upon by pressure faces projecting on the inside of the cover cap, solely at points lying diagonally opposite one another on this front wedge edge region, and the remaining regions in the vicinity of the edge lie opposite a free space within the cover cap. This measure proves to be paramount for the reliable opening of the lip. Only when these features are present does the lip open as a result of the tearing of the thin spot. Opening takes place such that, first, at the two ends of the lip comprising the two parts, the thin spot tears open on account of the geometry of the neck and the internal shape of the cover cap, and the lip forms an arc there. FIG. 5 shows the neck 2 with the slipped-over cover cap 3 as seen in a section from the front, and FIG. 6 shows said neck with the slipped-over cover cap 3 in a section from the side, with the outer contour of the cover cap 3 being indicated. Here, too, the twisting of the upper edge of the cover cap 3 becomes clear.

Figure 7:
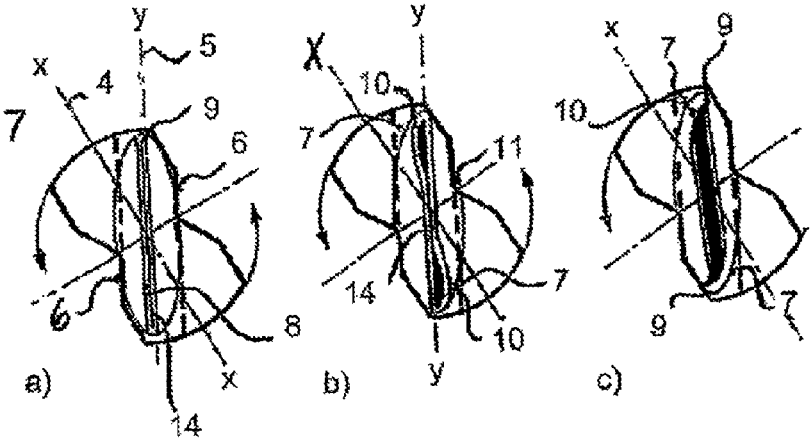
FIG. 7 shows the neck, as seen from above, in three phases a, b and c of the rotational movement of the cover cap.

FIG. 7 shows the opening of the lip on the neck in three phases. First, when the cover cap is rotated counterclockwise, the neck is pressed or rotated to the side at the two regions 6, as shown in FIG. 7*a*. These press faces 6 are configured to run outwardly toward the ends of the lip. During the further rotation of the cover cap, as indicated by the arrows, the thin spot first tears open at its two ends, as shown in FIG. 7*b*, and the lip part lying in each case opposite the press face 6 forms an outwardly curved arc 10. For this purpose, within the cover cap 3, the inside must be configured by means of a corresponding offset face 7 such that the necessary free space is provided, this being very important. During the further rotation of the cover cap 3, the thin spot is torn further, until finally the lip is opened completely, that is to say as far as the end points 9 of the thin spot, as shown in FIG. 7*c*.

Figure 8:
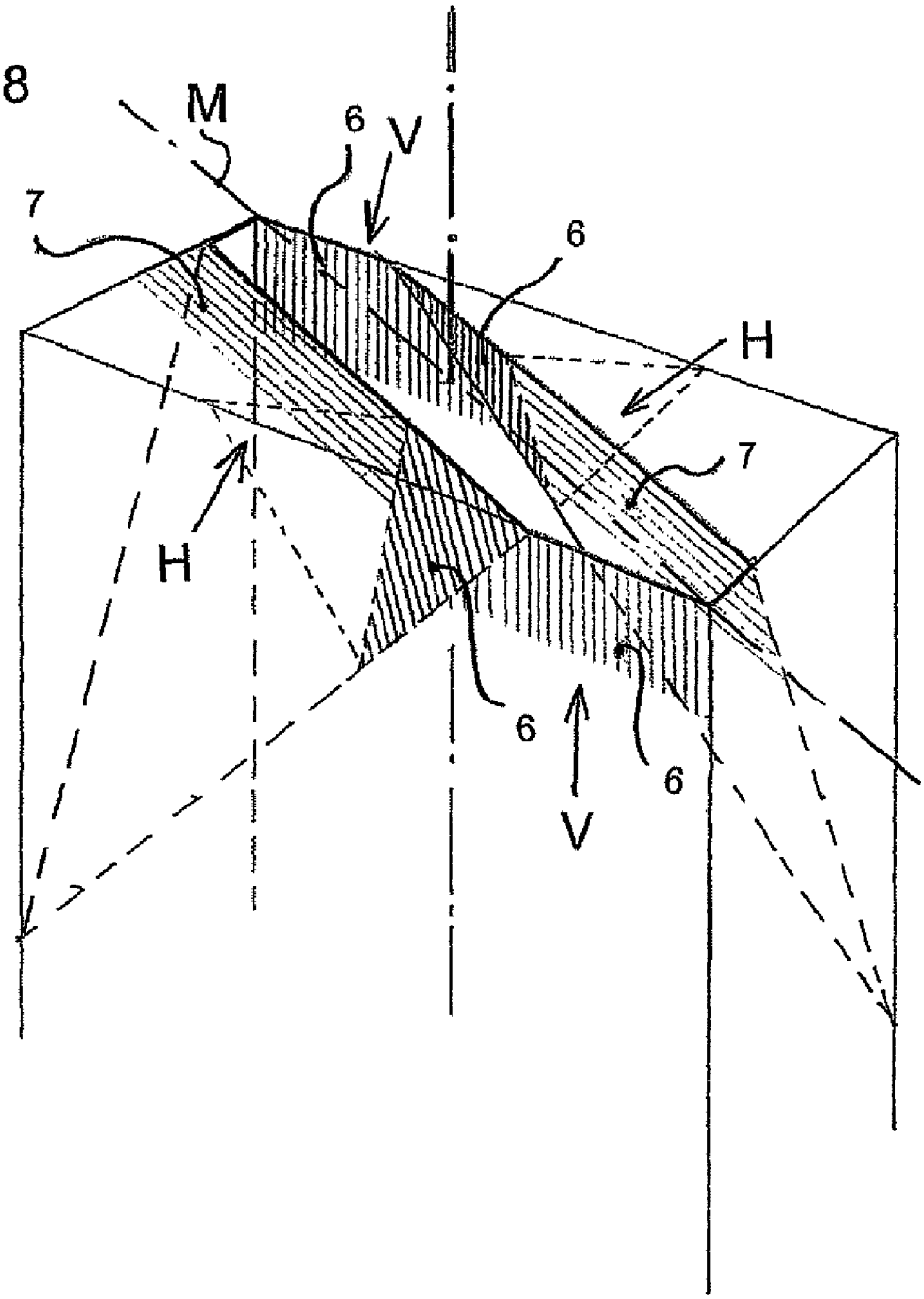
FIG. 8 shows a diagrammatic illustration of the internal configuration of the cover cap with the active faces of the slipped-over cover cap and with the active faces during the twisting of the cover cap in the opening operation.

FIG. 8 shows a diagrammatic illustration of the internal configuration of the cover cap with the active faces of the slipped-over cover cap and with the active faces during the twisting of the cover cap in the opening operation. The inside of the cover cap is configured such that, when rotated counterclockwise, as seen from above, it forms in each case in the front region a press face 6 with respect to the surrounded neck, which press face 6 runs in its front half (front=V) toward the centerline (M) of the longhole-shaped end of the cap-tip interior, while, in the region (rear=H) behind the press face 6, there follows a face 7 which is configured such that it leaves a free space open with respect to the inner neck.

Figure 9:
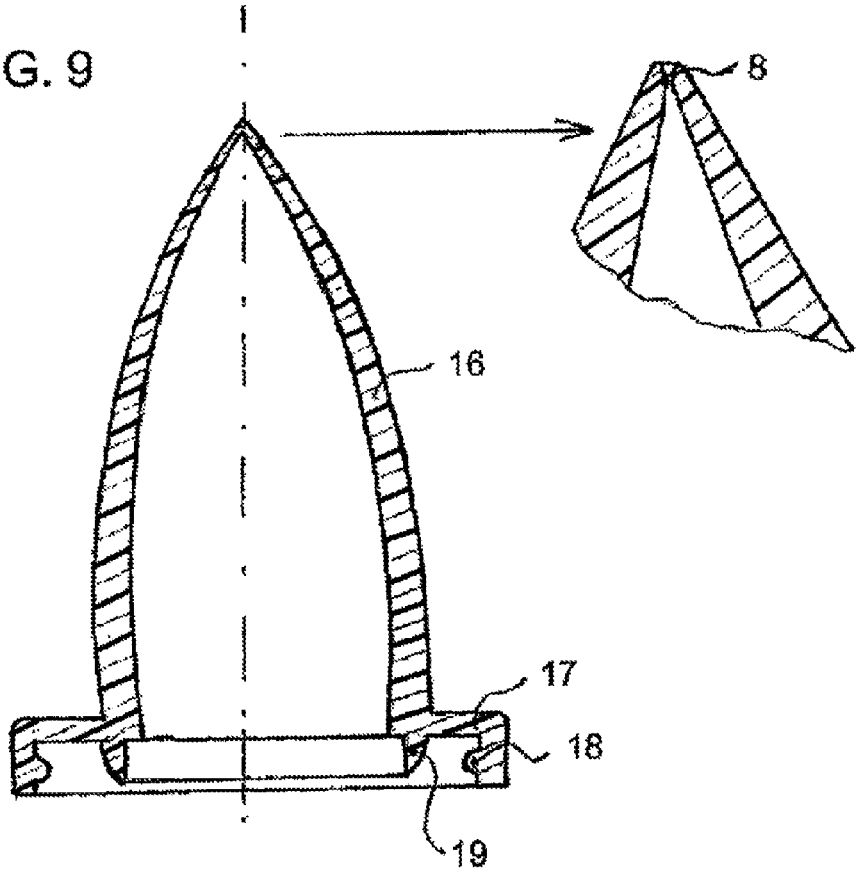
FIG. 9 shows a neck in cross section, with a thin spot set back at the wedge edge.
Figure 10:
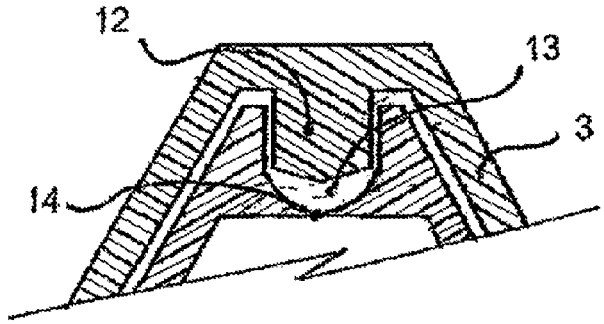
FIG. 10 shows the tip of the neck according to FIG. 9 in cross section, with the associated cover cap having an opening blade.
Figure 11:
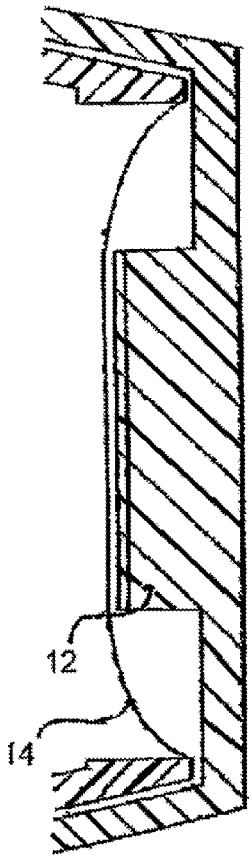
FIG. 11 shows the tip of the neck according to FIG. 9 in longitudinal section, with the associated cover cap having an opening blade.

FIG. 9 shows in cross section a neck which can be bounced onto a container neck, since, of course, it is produced from an elastic soft material. For bouncing it on, it has a shoulder 17, and, on the inside of the downwardly projecting margin adjoining the shoulder 17, a bead 18, by means of which the neck can be bounced onto a container neck. A sealing ring 19 is integrally formed at the lower end of the actual neck 16. As a special feature, the thin spot 14 of this neck 16 is set back in the wedge edge, so that a slot 13 is formed via this thin spot 14. This thin spot 14 is torn open by means of an opening blade 12 integrally formed on the inside of the cover cap, as is clear from FIG. 10. FIG. 11 shows the tip of the neck in longitudinal section with its thin spot 14 and also with the associated cover cap having an opening blade 12.

Figure 12:
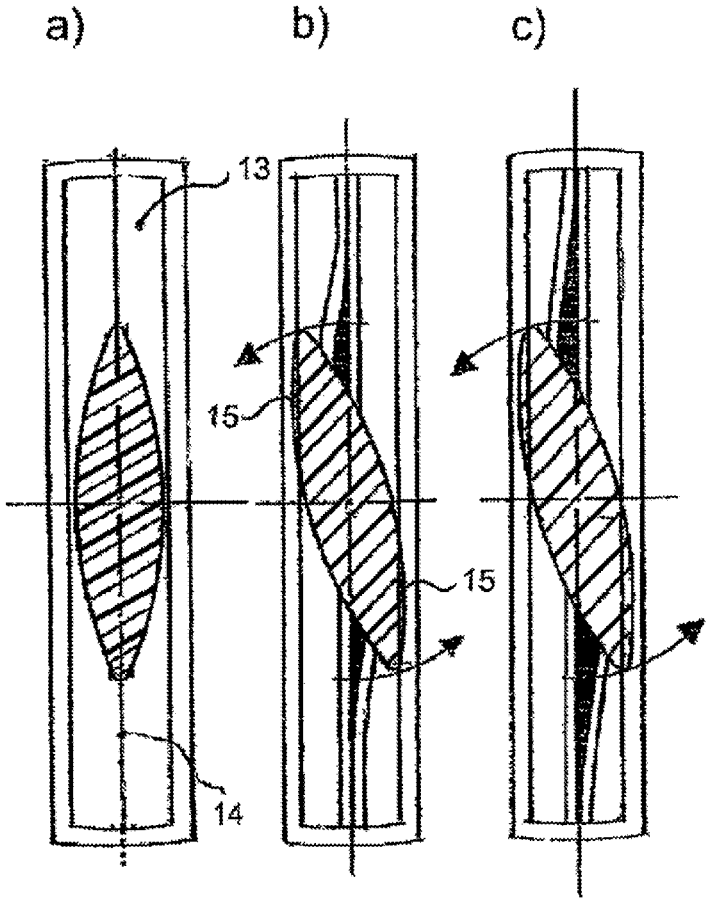
FIG. 12 shows the tip of the neck and the opening blade, as seen from above, in three phases a, b and c of a rotational movement of the cover cap.

In FIG. 12, the tip of the neck and the opening blade are seen from above, and the opening operation is illustrated in three phases a, b and c of the rotational movement of the cover cap. The opening blade therefore rotates in the slot 13 above the thin spot 14 which is thereby torn open, as illustrated in the drawings. Forces act on the actual thin spot at the point 15 and press the two lip parts away from one another, but also shear forces which displace the lip parts with respect to one another in the longitudinal direction. The length of the opening blade 12 engaging between the lips above the thin spot lies between ⅓ and ⅔ of the length of the thin spot 14 in the lip, this opening blade being arranged with its length centered with respect to the length of the thin spot.

Figure 13:
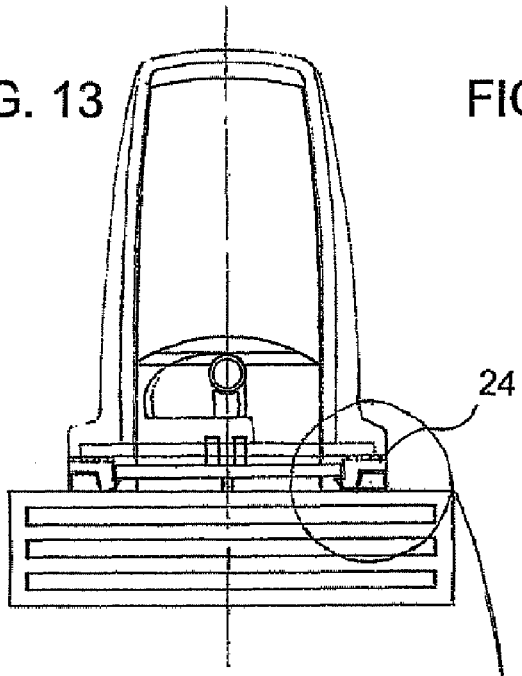
FIG. 13 shows a neck with cover cap in a longitudinal section, and next to it, in an enlarged illustration, the elements for the initial-opening assurance.
Figure 14:
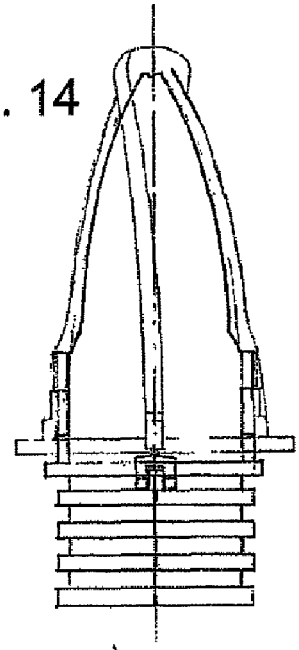
FIG. 14 shows the neck according to FIG. 13 with cover cap in a cross section.

FIG. 13 shows a neck with a cover cap in longitudinal section and, next to this, in an enlarged illustration, the elements for initial-opening assurance. These are a latching element 20 which is integrally formed on the underside of the cover cap via the small material bridges 24. The counterpiece 21 fitting positively with this is integrally formed on the shoulder of the neck. When the cover cap is for the first time slipped over the neck and pressed, these two latching elements 20, 21 snap one into the other. The cover cap can thereafter be removed only by being twisted with a force such that the material bridges 24 break. In FIG. 14, this neck according to FIG. 13 with cover cap is drawn in a cross section. Its base is shaped such that it is suitable for being welded into a standing bag.

Figure 15:
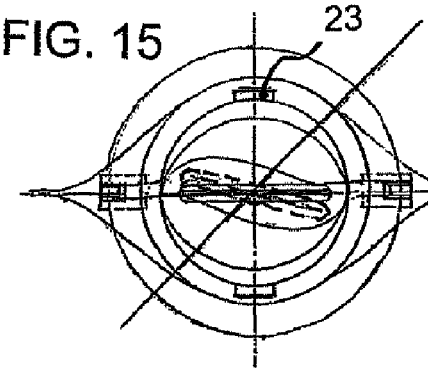
FIG. 15 shows the neck according to FIG. 13 with cover cap, as seen from above.
Figure 15:
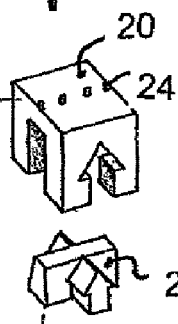
Figure 16:
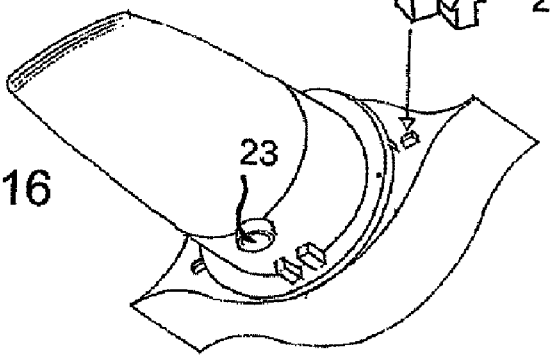
FIG. 16 shows the neck according to FIG. 13 in a perspective illustration.
Figure 17:
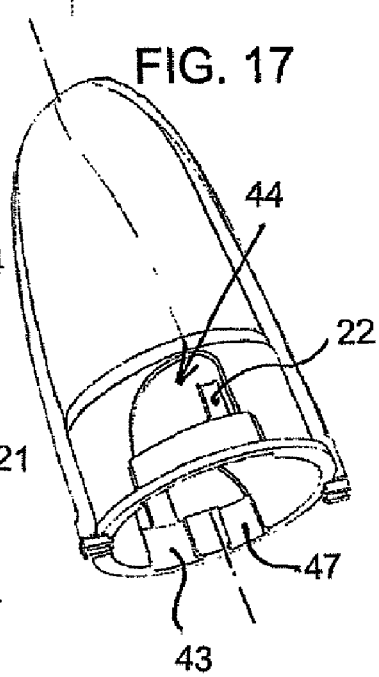
FIG. 17 shows the cover cap for the neck according to FIG. 13 in a perspective illustration.

In FIG. 15, the neck according to FIG. 13 with cover cap is seen from above. The twisting of the upper edge of the cover cap with respect to the detensioned shaped of the inner neck lip can be seen here once again. FIG. 16 shows the neck according to FIG. 13 in a perspective illustration, and FIG. 17 shows the associated cover cap. On the latter, the spring element 22 can be seen, which projects into the recess 44 intended for receiving the boss 23 when the cover cap is slipped over the neck. For this purpose, the bosses 23 slide through the sliding grooves 43 and, when the cover cap is removed, through the adjacent sliding grooves 47.

In a variant, this neck closure can be injection-molded as a one-piece part. This is shown in a first solution in FIG. 19. For this purpose, both the neck and the cover cap are injection-molded from the same elastic and soft material and are connected to a flap hinge 28 of U-shaped cross section which is provided at the end with a grip tab 29. In the example shown, the neck is integrally formed on the cover cap 26 which has an internal thread 25. On the outside of the neck can be seen a threaded rib which cooperates with a threaded rib 31 on the inside of the cover cap, so that the cap, when turned loose, is lifted off somewhat from the neck. The position shown in FIG. 18 is the injection-molding position. After the injection molding, the cover cap is swung onto the neck and slipped over it. To open the closure, with the lip of the neck, of course, being closed, first the flap hinge is torn away and thereafter the cover cap can be twisted with respect to the neck, thus causing the thin spot in the lip to be torn open.

This neck closure is illustrated, as seen from above, in FIG. 18. It can be seen here that the direction of run of the top edge of the cover cap is at an acute angle to the direction of run of the lip on the neck. The flap hinge is connected to the cover cap and to the neck via thin spots 32, 33, and therefore it can be torn away from these parts by the grip tab 29 being grasped. FIG. 20 shows this neck closure according to FIG. 18 in the closed state, as seen from the rear, where the thin spots 32, 33 on both sides of the flap hinge 28 and also the grip tab 29 can be seen. Finally, FIG. 21 illustrates a perspective view of the neck closure in the swung-up state of the cover cap.

Figure 22:
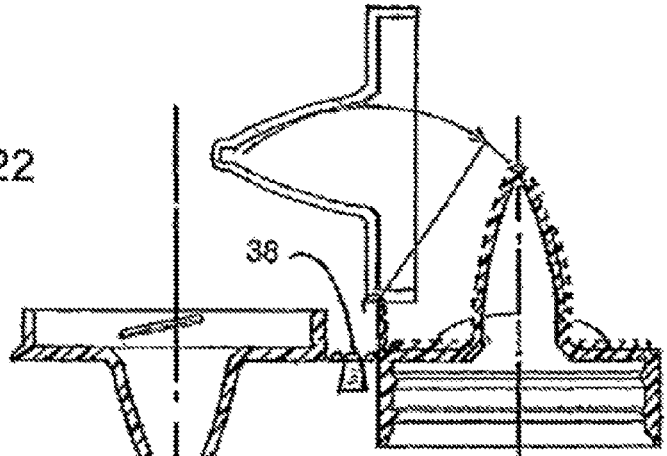
FIG. 22 shows a neck closure with a cover cap connected in one part to the neck via a separable flap hinge, as illustrated in cross section.
Figure 23:
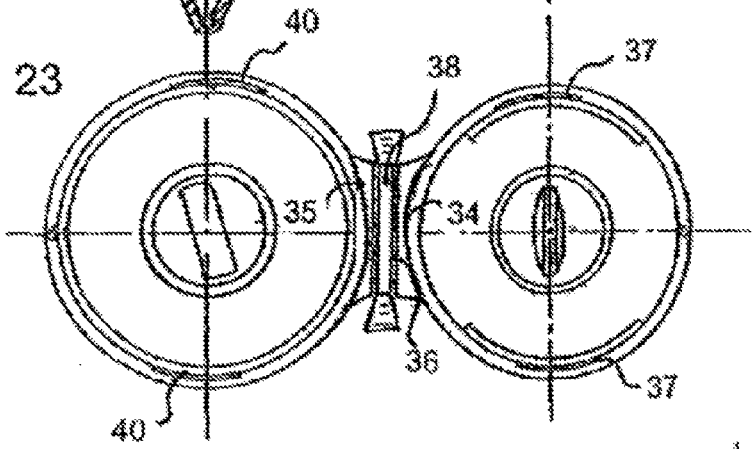
FIG. 23 shows the neck closure according to FIG. 22, as seen from above.

FIG. 22 shows a neck closure in another variant in which the cover cap is connected in one part to the neck via a separable flap hinge. Here, the flap hinge has a tear-out middle part 38 which is connected on both sides to the outer hinge parts only via a thin spot or via a number of fine material bridges. This can best be seen from FIG. 23 where the neck closure is shown, as seen from above. The flap hinge is integrally formed on the neck and on the cover cap along the curved lines 34, 35. The middle part 38 is held only via fine material bridges 36 and can therefore be torn out of the flap hinge by tearing at the grip tabs. Here too, the various directions of run of the upper cover cap edge and of the lip on the neck can be seen. On both parts, threaded ribs 38, 40 are present, which take effect when the threaded cap previously slipped onto the neck is turned loose.

Figure 24:
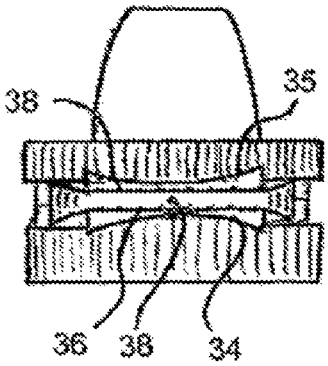
FIG. 24 shows the neck closure according to FIG. 22 in the closed state, as seen from the rear.
Figure 25:
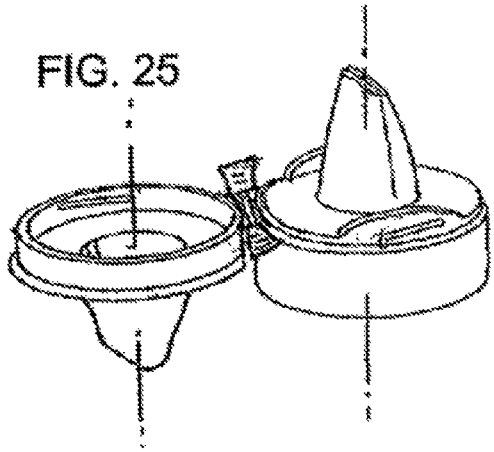
FIG. 25 shows the neck closure according to FIG. 22 in the swung-open state of the cover cap, in a perspective view.

FIG. 24 shows this neck closure in the closed state, as seen from the rear, and FIG. 25 shows it in the swung-up state of the cover cap in a perspective view. In a further variant, the neck closure can be produced in one piece in that the cover cap and the neck base are produced as one piece from polypropylene via a separable or tear-away flap hinge, while the neck consisting of low-density polyethylene LDPE is injection-molded in a second injection component onto the neck base.

Figure 26:
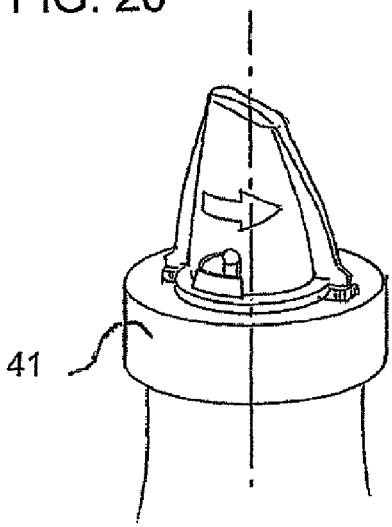
FIG. 26 shows a neck closure with a securing device for the cover cap when the cover cap is put in place, in an application as a cover for a container neck or bottle neck.
Figure 27:
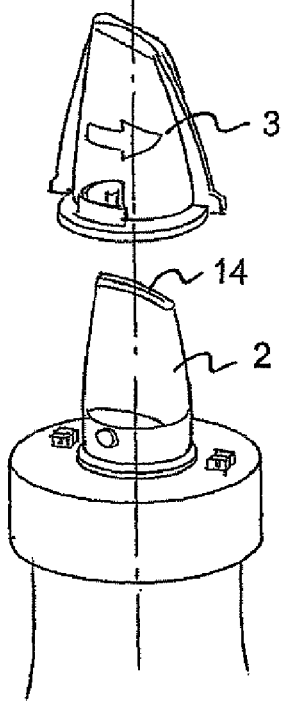
FIG. 27 shows the neck closure according to FIG. 26 with the cover cap lifted away.
Figure 28:
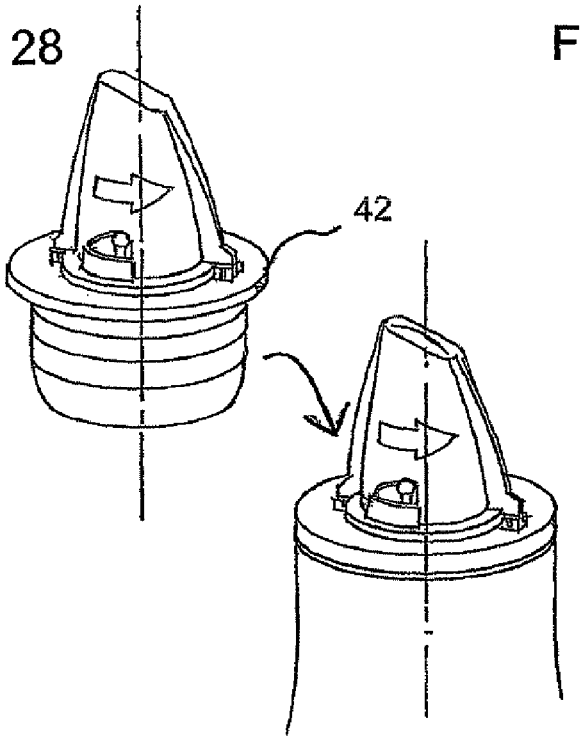
FIG. 28 shows a neck closure with a securing device for the cover cap when the cover cap is put in place, in an application as a spigot closure for a container neck or bottle neck.
Figure 29:
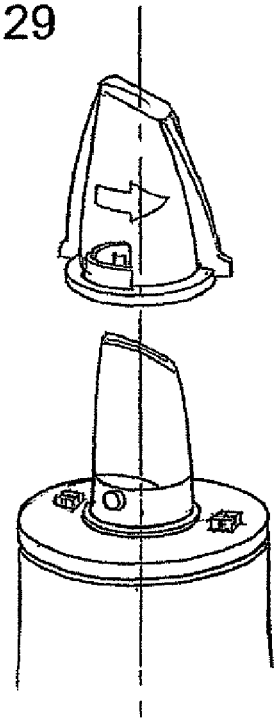
FIG. 29 shows the neck closure according to FIG. 28 with the cover cap lifted away.
Figure 30:
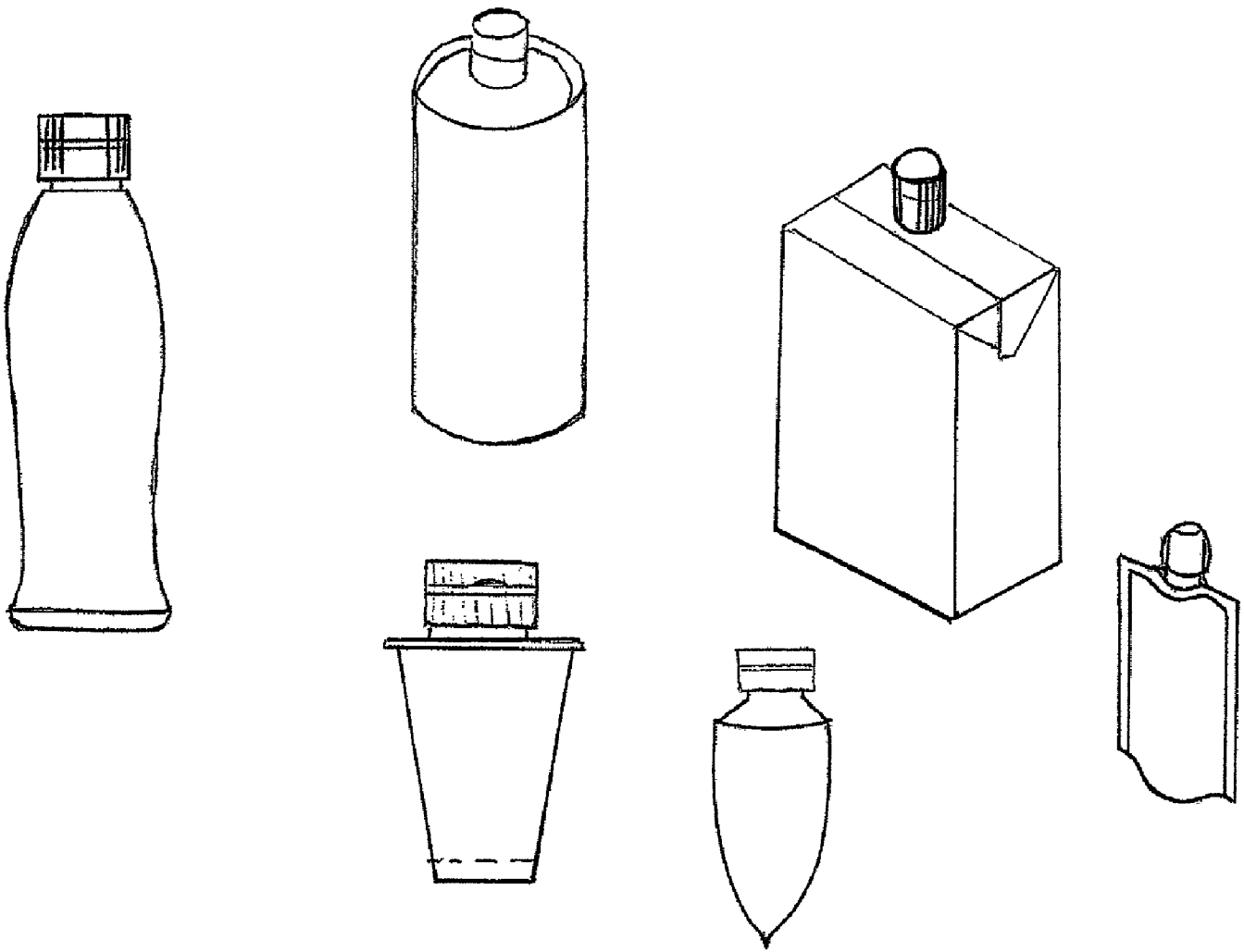
FIG. 30 shows various containers and casks for which the neck closure is suitable.

This neck closure may be designed for the most diverse possible containers. Some examples are shown and mentioned below. Thus, FIG. 26 shows a neck closure with a securing device for the cover cap, with the cover cap attached, in an application as a cover for a container neck or bottle neck. The base of the neck is therefore designed as a cap, with an internal thread or with an inner bead for screwing or bouncing onto a container neck. FIG. 27 shows this neck closure with the cover cap lifted away. FIG. 28 shows a neck closure with a securing device for the cover cap, with the cover cap attached, in an application as a spigot closure for a container neck or bottle neck. The neck sits on a base which is designed at the bottom as a hollow spigot or nipple, so that it can be plugged into a neck. FIG. 29 shows this neck closure with the cover cap lifted away. Finally, FIG. 30 shows, further, the various containers and casks which can be equipped with it.

Figure 31:
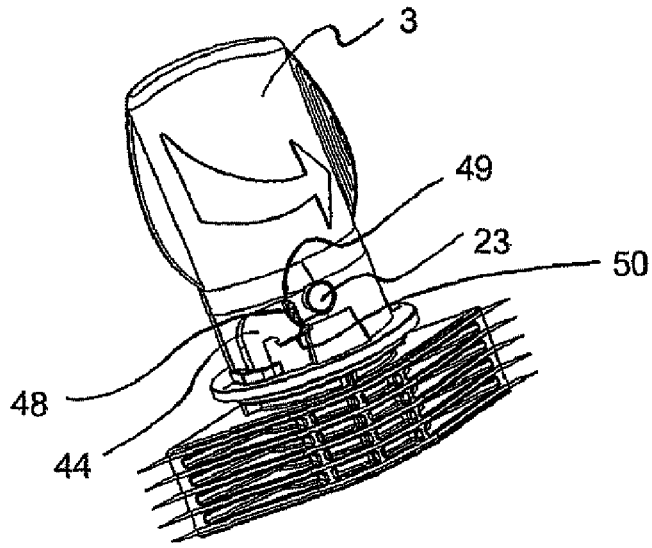
FIG. 31 shows a second assurance device as initial-opening assurance.
Figure 31:
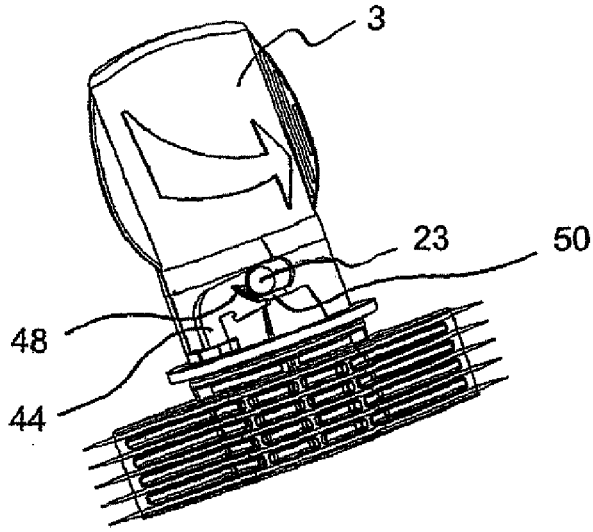
Figure 31:
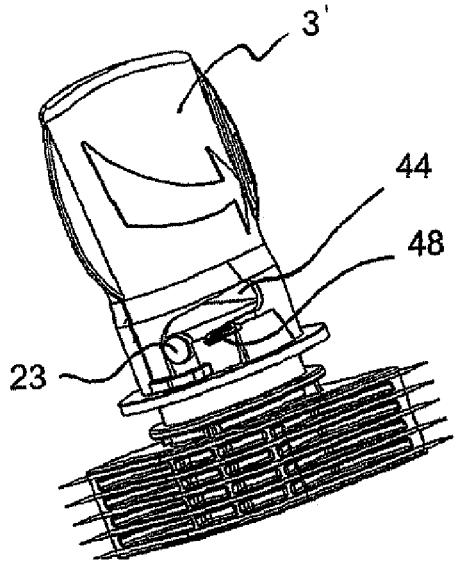

FIGS. 31 *a*) to *c*) show a further assurance device and its action for offering initial-opening assurance. For this purpose, blocking flaps 48 are integrally formed on the cover cap 3 and project into the recess 44. At the root of each blocking flap 48, the latter is connected to the margin of the recess 44 via a thin spot 50 and at its opposite end is connected, via a material bridge 49 acting as a predetermined breaking point, to that margin of the recess 44 which is located there. When the cover cap 3 is twisted in the opening direction, the bosses 23 on the pour-out neck act on these blocking flaps 48, with the result that the material bridges break and the blocking flaps 48 are swung downward. As a result, the cover cap 3 can be rotated further and then pulled off. These blocking flaps 48 are visible from outside and therefore offer initial-opening assurance.

The invention claimed is:

1. A neck closure comprising a hermetically sealed neck and a cover cap for opening, comprising a wedge-shaped hollow neck with lip parts which are formed at a front wedge edge by two wedge faces tapering toward one another and which are connected in one piece via a thin region to form a closed lip, and of a cover cap capable of being slipped over this wedge-shaped neck, characterized in that, in a slipped-over state, the cover cap has an internal shape configured to hold a front region of the wedge-shaped neck, twisted clockwise, as seen from above, through at least 5 degrees with respect to its detensioned normal position, and in that, when the cover cap is rotated out of this closing position, the thin region is torn when the front wedge edge region of the neck is acted upon counterclockwise, as seen from above, by pressure faces projecting on an inside of the cover cap, solely at points lying diagonally opposite one another on this front wedge edge region, and remaining regions in a vicinity of the edge lie opposite a free space within the cover cap.

2. A neck closure comprising a hermetically sealed neck and a cover cap for opening, comprising a wedge-shaped hollow neck with lip parts which are formed at a front wedge edge by two wedge faces tapering toward one another and which are connected in one piece via a thin region to form a closed lip, and of a cover cap capable of being slipped over this wedge-shaped neck, characterized in that the thin region is set back with respect to the front wedge edge, and that the cover cap capable of being slipped over this wedge-shaped neck has on its inside an opening blade which engages between the two lip parts as far as the thin region, so that, when the cover cap is rotated out of a closing position counterclockwise, as seen from above, the opening blade, by being twisted, presses the lip parts apart, with the thin region being broken, and opens the lip.

3. The neck closure comprising a hermetically sealed neck and a cover cap for opening as claimed in claim 1, characterized in that the inside of the cover cap is configured such that, when rotated counterclockwise, as seen from above, it forms in the front region a press face with respect to the surrounded neck, which press face runs in its front half toward a centerline of a longhole-shaped end of a cap-tip interior, while, in a region behind the press face, there follows a face which is configured such that it leaves a free space open with respect to the inner neck.

4. The neck closure comprising a hermetically sealed neck and a cover cap for opening as claimed in claim 2, characterized in that a length of the opening blade engaging between the lips above the thin region is between ⅓ and ⅔ as long as a length of the thin region in the lip, and in that the opening blade is arranged with its length centered with respect to the length of the thin region.

5. The neck closure comprising a hermetically sealed neck and a cover cap for opening as claimed in claim 1, characterized in that the neck and the cover cap are produced in one piece in that they are connected to one another via a film hinge which is connected either as a whole merely via a thin region or via some material bridges to the neck and the cover cap so that the film hinge can be torn away as a whole from these, or that the film hinge includes a continuous region which runs along its hinge axis and which is connected to the two hinge sides on both sides solely via a thin region or some material bridges intended for acting as predetermined breaking points and can therefore be torn away from the hinge.

6. The neck closure comprising a hermetically sealed neck and a cover cap for opening as claimed in claim 5, characterized in that the film hinge or its tearaway region are provided at least on one hinge side with a grip tab.

7. The neck closure comprising a hermetically sealed neck and a cover cap for opening as claimed in claim 1, characterized in that the neck closure, with the exception of the actual neck, is produced in one piece from polypropylene, while the neck comprising low-density polyethylene is injection-molded in a second injection component onto a neck base.

8. The neck closure comprising a hermetically sealed neck and a cover cap for opening as claimed in claim 1, characterized in that, on a neck base, on the one hand, and on a lower margin of the cover cap, on the other hand, latching elements engaging one in the other are injection-molded as initial-opening assurance and latch one into the other when the cover cap is placed onto the neck for the first time, one of the latching elements being connected to the neck base or to the lower margin of the cover cap solely via material bridges designed as predetermined breaking points.

9. The neck closure comprising a hermetically sealed neck and a cover cap for opening as claimed in claim 1, characterized in that a boss is integrally formed on each side of the neck-in a vicinity of the neck base, and in that the cover cap has in a vicinity of its lower margin on each side, a recess, to which leads a sliding groove which runs out at the lower margin and rises upward and inward, so that, when the cover cap is placed onto the neck, the bosses slide through the sliding grooves and latch into the recesses, furthermore in that the recesses merge at their top into a widening limited at the top by an arcuate margin, so that, when the rotary cap is rotated counterclockwise, these widenings are guided with their arcuate margins on the top side of the bosses and are pushed over the bosses, after which the cover cap can be lifted upward away from the neck.

10. The neck closure comprising a hermetically sealed neck and a cover cap for opening as claimed in claim 1, characterized in that threaded ribs are integrally formed laterally on the neck in a vicinity of a neck base and cooperate with threaded ribs on an inside of the cover cap in such a way that, when the cover cap is rotated counterclockwise, as seen from above, the cover cap is raised.

11. The neck closure comprising a hermetically sealed neck and a cover cap for opening as claimed in claim 1, characterized in that at least one blocking flap, which is integrally formed on the cover cap as initial-opening assurance, projects into a recess in the cover cap and is connected at its root to a margin of the recess via a thin region and which is connected at its opposite end, via a material bridge acting as a predetermined breaking point, to an opposite margin of the recess, said blocking flap being capable of being pivoted away as a result of the twisting of the cover cap, with the material bridge being broken.

12. A neck closure comprising a hermetically sealed neck and a cover cap for opening, comprising a wedge-shaped hollow neck with lip parts which are formed at a front wedge edge by two wedge faces tapering toward one another and which are connected in one piece via a thin region to form a closed lip, and of a cover cap capable of being slipped over this wedge-shaped neck, characterized in that, in a slipped-over state, the cover cap has an internal shape configured to hold a front region of the wedge-shaped neck, twisted in a first direction, as seen from above, through at least 5 degrees with respect to its detensioned normal position, and in that, when the cover cap is rotated out of this closing position, the thin region is torn when the front wedge edge region of the neck is acted upon in a second direction opposite the first direction, as seen from above, by pressure faces projecting on an inside of the cover cap, solely at points lying diagonally opposite one another on this front wedge edge region, and remaining regions in a vicinity of the edge lie opposite a free space within the cover cap.

13. The neck closure comprising a hermetically sealed neck and a cover cap for opening as claimed in claim 12, characterized in that the inside of the cover cap is configured such that, when rotated in the second direction, as seen from above, it forms in the front region a press face with respect to the surrounded neck, which press face runs in its front half toward a centerline of a longhole-shaped end of a cap-tip interior, while, in a region behind the press face, there follows a face which is configured such that it leaves a free space open with respect to the inner neck.

14. The neck closure comprising a hermetically sealed neck and a cover cap for opening as claimed in claim 12, characterized in that the neck and the cover cap are produced in one piece in that they are connected to one another via a film hinge which is connected either as a whole merely via a thin region or via some material bridges to the neck and the cover cap so that the film hinge can be torn away as a whole from these, or that the film hinge includes a continuous region which runs along its hinge axis and which is connected to the two hinge sides on both sides solely via a thin region or some material bridges intended for acting as predetermined breaking points and can therefore be torn away from the hinge.

15. The neck closure comprising a hermetically sealed neck and a cover cap for opening as claimed in claim 14, characterized in that the film hinge or its tear-away region are provided at least on one hinge side with a grip tab.

16. The neck closure comprising a hermetically sealed neck and a cover cap for opening as claimed in claim 12, characterized in that the neck closure, with the exception of the actual neck, is produced in one piece from polypropylene, while the neck comprising low-density polyethylene is injection-molded in a second injection component onto a neck base.

17. The neck closure comprising a hermetically sealed neck and a cover cap for opening as claimed in claim 12, characterized in that, on a neck base, on the one hand, and on a lower margin of the cover cap, on the other hand, latching elements engaging one in the other are injection-molded as initial-opening assurance and latch one into the other when the cover cap is placed onto the neck for the first time, one of the latching elements being connected to the neck base or to the lower margin of the cover cap solely via material bridges designed as predetermined breaking points.

18. The neck closure comprising a hermetically sealed neck and a cover cap for opening as claimed in claim 12, characterized in that a boss is integrally formed on each side of the neck in a vicinity of the neck base, and in that the cover cap has in a vicinity of its lower margin on each side, a recess, to which leads a sliding groove which runs out at the lower margin and rises upward and inward, so that, when the cover cap is placed onto the neck, the bosses slide through the sliding grooves and latch into the recesses, furthermore in that the recesses merge at their top into a widening limited at the top by an arcuate margin, so that, when the rotary cap is rotated in the second direction, these widenings are guided with their arcuate margins on the top side of the bosses and are pushed over the bosses, after which the cover cap can be lifted upward away from the neck.

19. The neck closure comprising a hermetically sealed neck and a cover cap for opening as claimed in claim 12, characterized in that threaded ribs are integrally formed laterally on the neck in a vicinity of a neck base and cooperate with threaded ribs on an inside of the cover cap in such a way that, when the cover cap is rotated in the second direction, as seen from above, the cover cap is raised.

20. The neck closure comprising a hermetically sealed neck and a cover cap for opening as claimed in claim 12, characterized in that at least one blocking flap, which is integrally formed on the cover cap as initial-opening assurance, projects into a recess in the cover cap and is connected at its root to a margin of the recess via a thin region and which is connected at its opposite end, via a material bridge acting as a predetermined breaking point, to an opposite margin of the recess, said blocking flap being capable of being pivoted away as a result of the twisting of the cover cap, with the material bridge being broken.

* * * * *